US006726313B1

(12) United States Patent
Oda et al.

(10) Patent No.: US 6,726,313 B1
(45) Date of Patent: Apr. 27, 2004

(54) INK JET PRINTER

(75) Inventors: Kazuyuki Oda, Ebina (JP); Ichiro Tomikawa, Ebina (JP); Atsumichi Imazeki, Ebina (JP); Fumihiko Ogasawara, Ebina (JP); Yumiko Namba, Ebina (JP); Jun Isozaki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/650,665

(22) Filed: Aug. 30, 2000

(30) Foreign Application Priority Data

Nov. 10, 1999 (JP) ..... 11-320095

(51) Int. Cl.[7] ..... B41J 2/175
(52) U.S. Cl. ..... 347/85
(58) Field of Search ..... 347/85, 86, 87, 347/7, 92, 93

(56) References Cited

U.S. PATENT DOCUMENTS 4,968,998 A * 11/1990 Allen ..... 347/7
5,821,965 A * 10/1998 Oda et al. ..... 347/86
5,997,121 A * 12/1999 Altfather et al. ..... 347/7
6,022,102 A * 2/2000 Ikkatai et al. ..... 347/85
6,234,615 B1 * 5/2001 Tsukuda ..... 347/85
6,520,630 B1 * 2/2003 Oda et al. ..... 347/85

FOREIGN PATENT DOCUMENTS

| | | |
|---|---|---|
| JP | 54-31898 | 10/1979 |
| JP | 60-9903 | 3/1985 |
| JP | 63-51868 | 10/1988 |
| JP | 7-51356 | 6/1995 |
| JP | 2772014 | 4/1998 |

* cited by examiner

*Primary Examiner*—Michael Nghiem
(74) *Attorney, Agent, or Firm*—Morgan Lewis & Bockius LLP

(57) ABSTRACT

An ink jet printer is disclosed which, only when ink is to be supplied, supplies ink from a main tank disposed outside a carriage and which can effect the supply of ink stably without the leakage of ink. When it is detected by an ink level sensor that the ink level in a second ink chamber of an ink tank has become lower than a predetermined position, pipes in ports are inserted respectively into slit valves provided in the second ink chamber. Then, by operating a pump, the air present in the second ink chamber is discharged by suction to increase a negative pressure in the second ink chamber, allowing ink to be supplied from a main tank into the second ink chamber. Thus, since the supply of ink is performed by a negative pressure, it is possible to prevent the leakage of ink from the portion where the pipe is inserted into the slit valve.

17 Claims, 5 Drawing Sheets

INK JET PRINTER

BACKGROUND OF THE INVENTION

1. Field of the Invention

The present invention relates to an ink jet printer and more particularly to an ink jet printer wherein ink is supplied to an ink tank disposed on a movable carriage from a main tank provided outside the movable carriage.

2. Description of the Prior Art

According to a known ink jet printer, a main tank is provided outside a movable carriage and ink is supplied (replenished) from the main tank to an ink tank disposed on the movable carriage.

For example, in Japanese Published Examined Patent Application No. Sho 54-31898 (hereinafter referred to as the "prior art reference 1") there is disclosed a construction wherein a liquid reservoir filled with a liquid absorber is provided within a print head, and a wick provided in a liquid filling device is inserted into the liquid reservoir from a fill opening and is brought into contact with the liquid absorber, whereby ink is supplied to the liquid reservoir from the liquid filling device under the action of capillarity.

In Japanese Published Examined Patent Application No. Sho 60-9903 ("prior art reference 2" hereinafter) there is disclosed a construction wherein the amount of ink remaining in an ink tank disposed on a carriage is detected and if it is below a predetermined amount, the carriage is moved to a print stand-by position and ink is replenished to the ink tank by being dropped from a base tank provided at an upper position.

In Japanese Published Examined Patent Application No. Sho 63-51868 ("prior art reference 3" hereinafter) there is disclosed a construction wherein a sub-tank and a main tank both mounted on a carriage are connected together through a feed pipe and, when the ink in the sub-tank decreases, ink is fed under pressure into the sub-tank by pressing the main tank, while air present within the sub-tank is discharged through a discharge pipe into a bag-like container.

In Japanese Published Examined Patent Application No. Hei 7-51356 ("prior art reference 4") there is disclosed a construction wherein a first tank disposed on a carriage and a second tank disposed outside the carriage are connected together through two connecting pipes and ink is fed under pressure from the second tank to the first tank through one of the connecting pipes, while an overflow is recovered into the second tank through the other.

Further, in Japanese Patent No. 2772014 ("prior art reference 5" hereinafter) there is disclosed a construction wherein, when a residual amount detecting electrode in a first ink tank disposed on a carriage detects reduction of the residual amount of ink, a mechanical valve in a tube which connects the first ink tank and a second ink tank disposed outside the carriage with each other is opened, whereby ink is replenished automatically from the second ink tank which is located at a higher position than the first ink tank.

The above conventional ink jet printers involve the following inconveniences.

In the prior art reference 1, a satisfactory ink shift cannot be done in some particular liquid distribution condition in the interior of the liquid reservoir, and the evaporation and denaturation of ink are apt to occur because the wick is exposed at all times.

In the prior art reference 2, the dropped ink adheres to a wall surface or the like and is denatured or solidified, which may obstruct printing.

In the prior art reference 3, the internal pressure of the sub-tank becomes a positive pressure because ink is fed to the sub-tank under pressure, and the positive pressure also acts on a print head orifice, causing the leakage of ink such as face-flood.

In the prior art reference 4, it is necessary that the first tank be disposed lower than a print head, and ink which has been increased in viscosity is pressurized so as to be discharged from the print head, so that ink is apt to leak from a connection.

In the prior art reference 5, there occurs ink leakage upon deterioration of the mechanical valve.

SUMMARY OF THE INVENTION

The present invention has been accomplished for eliminating the abovementioned inconveniences and provides an ink jet printer capable of preventing link leakage from a connection between a main tank disposed outside a carriage and an ink tank disposed on the carriage and thereby capable of ensuring a stable supply of ink.

According to the present invention, in one aspect thereof, there is provided an ink jet printer including an ink tank which is held on a movable carriage with a print head mounted thereon and in which ink is held so as to have a free surface, the ink tank having plural to-be-connected portions for the replenishment of ink; a main tank disposed outside the movable carriage and with the ink stored therein; a first connecting portion communicating with the main tank; a second connecting portion through which air is discharged to the exterior by means of an air suction part; and a connecting part which, at the time of ink supply, connects the first and second connecting portions respectively to the to-be-connected portions of the ink tank.

In the present invention, the supply of ink from the main tank disposed outside the movable carriage to the ink tank disposed on the movable carriage is performed in the following manner. First, the first and second connecting portions are connected respectively to the to-be-connected portions of the ink tank by the connecting part. Next, the air present in the interior of the ink tank is discharged to the exterior from the second connecting portion by the air suction part (e.g., a pump) to increase a negative pressure in the ink tank. As a result, ink is replenished from the main tank to the ink tank through the first connecting portion. Since the replenishment of ink is thus performed by suction of the ink from the main tank under the action of the negative pressure in the ink tank, there is no fear of ink leakage to the exterior from the connection between the first connecting portion and the corresponding to-be-connected portion of the ink tank.

In another aspect of the present invention, the ink tank is made up of a first ink chamber having an atmosphere communication port and with an ink holding capillary member accommodated therein, a second ink chamber which holds the ink so as to have a free surface, the second ink chamber having an ink supply port for the supply of ink to the print head and also having to-be-connected portions, and a meniscus forming member provided in a communicating portion between the first and second ink chambers, and the ink jet printer further includes a residual ink quantity detecting part which detects a residual ink quantity in the second ink chamber and a control part which, when the residual ink quantity is found to be below a predetermined quantity by the residual ink quantity detecting part, makes control to drive the connecting part so as to connect the first and second connecting portions respectively to the to-be-connected portions in the second ink chamber and also makes control to actuate the air suction part so as to replenish ink from the main tank to the ink tank.

In printing, the ink contained in the capillary member in the first ink chamber shifts to the second ink chamber by virtue of a negative pressure created by ejection of ink droplets from the print head. When the ink in the first ink chamber is used up, the ink present in the second ink chamber is consumed. In this case, bubbles break an ink meniscus film formed by the meniscus forming member and shift from the first to the second ink chamber to control the negative pressure in the second ink chamber to a level falling under a predetermined range, thereby maintaining the ejection of ink droplets from the print head in good condition. When the residual ink quantity is found to be below the predetermined quantity by the residual ink quantity detecting part, the ejection of ink droplets is stopped and the control part makes control to actuate the connecting part so as to connect the first and second connecting portions to the to-be-connected portions in the second ink chamber and also makes control to actuate the air suction part so as to discharge the air present in the second ink chamber and replenish ink from the main tank.

Thus, in normal printing, the negative pressure control on the print head side is performed with the ink tank alone independently, so the main tank can be installed freely with respect to the ink tank (print head) and the degree of freedom in components' arrangement becomes higher.

In a further aspect of the present invention, the ink jet printer is further provided with a closing part which closes the atmosphere communication port in the first ink chamber at the time of replenishing ink from the main tank to the ink tank.

Thus, during the supply of ink from the main tank to the ink tank, the atmosphere communication port in the first ink chamber is closed by the closing part. Therefore, when the air present in the second ink chamber is discharged to the exterior by suction to increase the negative pressure in the second ink chamber, there is no fear that the negative pressure in the second ink chamber may be decreased by the entry of air into the second ink chamber from the first ink chamber having the atmosphere communication port. That is, ink can be supplied from the main tank to the ink tank efficiently.

In a still further aspect of the present invention, the to-be-connected portions of the ink tank and the first and second connecting portions are connected together when the movable carriage is in its home position thereof.

Since the ink tank and the connecting portions of the ink replenishing station are connected together upon return of the movable carriage to its home position after printing, it is not necessary to move the carriage in a main-scanning direction, which is efficient. Further, since the replenishment of ink is performed at the home position, the print head is capped into a hermetically sealed state, so that it is possible to prevent the entry of air into the print head at the time of replenishment of ink.

In a still further aspect of the present invention, the residual ink quantity detecting part is an optical sensor which detects an ink level on the basis of a change in light transmittance caused by whether ink is present or not.

The light transmittance differs depending on whether ink is present up to the position (height) where the optical sensor is installed in the ink tank. Therefore, it is possible to surely detect the ink level on the basis of the transmittance of light and ink can be replenished from the main tank to the ink tank at an appropriate timing.

In a still further aspect of the present invention, a defective ink detecting part which detects defective ink on the basis of the rate of attenuation of light passing through the ink is provided in the communication path between the main tank and the first connecting portion.

In the case where the attenuation rate of light detected by the defective ink detecting part is outside a predetermined range, it is judged that inappropriate ink is flowing from the main tank to the ink tank. In this case, for example the printing operation is stopped and the replacement of ink is instructed. Thus, it is possible to prevent the occurrence of any inconvenience in the print head caused by the flow of inappropriate ink.

In a still further aspect of the present invention, the main tank is provided with an atmosphere release port which is opened when the main tank is loaded into the ink jet printer.

After shipping of the main tank and until it is loaded into the ink jet printer, there is a fear that ink may leak to the exterior through the atmosphere release port due to vibrations or depending on in which direction the main tank is placed. In the present invention, however, such ink leakage can be prevented because the atmosphere release port is opened when the main tank is loaded into the ink jet printer.

In a still further aspect of the present invention, the to-be-connected portions are provided in an upper portion of the ink tank.

Since the to-be-connected portions are located in an upper portion of the ink tank, the supply of ink to the second ink chamber can be done from above the ink level and not into the ink (below the ink level). Consequently, the amount of ink adhered to the connecting portions decreases and the solidifying of adhered ink is suppressed. Connecting the first and second connecting portions to the to-be-connected portions and closing the atmosphere communication port can be completed in a single operation and thus it is possible to effect the ink supplying operation efficiently.

BRIEF DESCRIPTION OF THE DRAWINGS

Preferred embodiments of the present invention will be described in detail with reference to the accompanying drawings, in which.

DETAILED DESCRIPTION OF THE PREFERRED EMBODIMENTS

An ink jet printer according to the first embodiment of the present invention will be described in detail hereunder with reference to the drawings.

Figure 2:
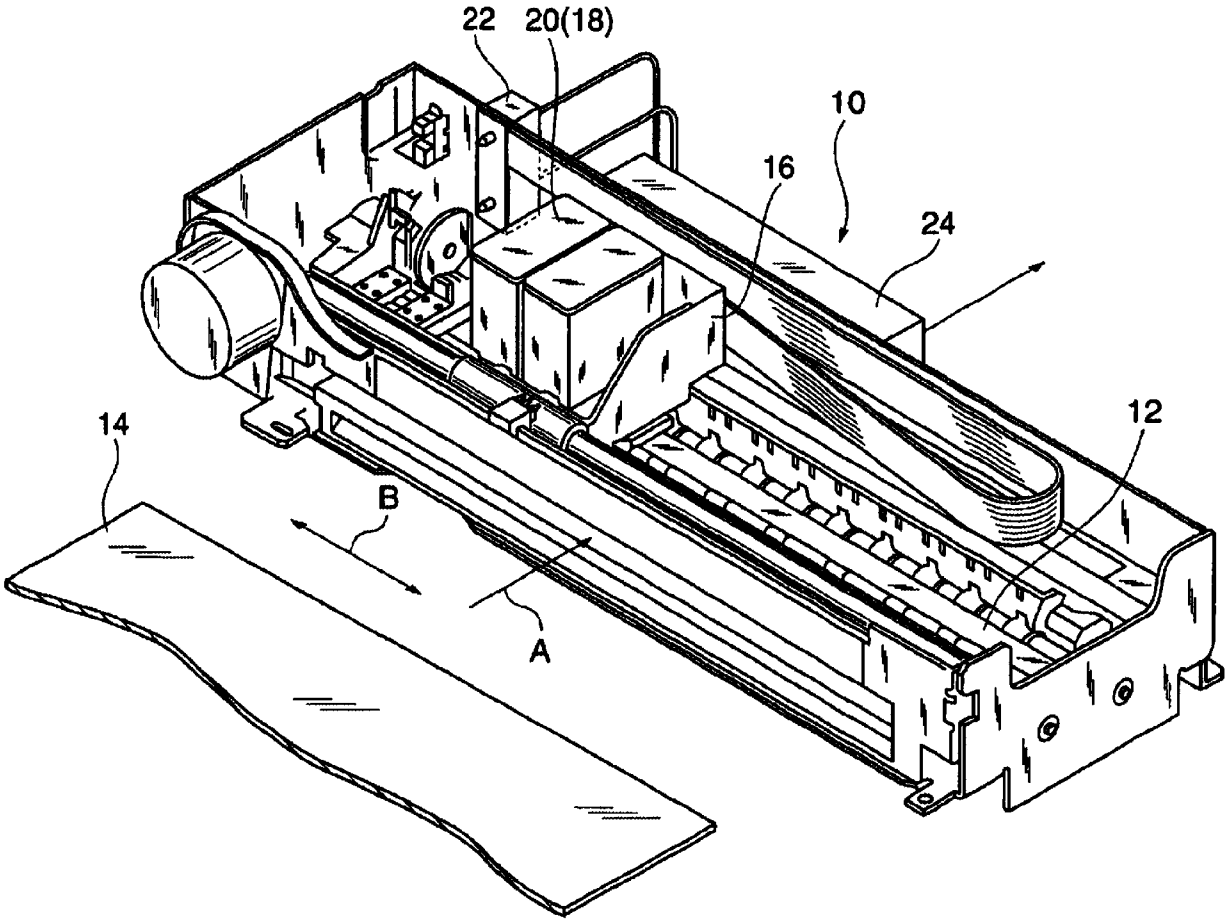
FIG. 2 is a perspective view of the ink jet printer.

As shown in FIG. 2, in an ink jet printer 10 is disposed a carriage 16 above paper 14 which is conveyed by a conveying roller 12, the carriage 16 being movable in a main-scanning direction (arrow B direction) which intersects a feed direction (a sub-scanning direction)(arrow A direction) of the paper 14. On the carriage 16 are provided print heads 18 for ejecting inks of black, yellow, magenta, and cyan colors toward the paper 14, as well as ink tanks 20 integral with the print heads 18. At an end portion (a home position) in the main-scanning direction of the ink jet printer 10 is disposed an ink replenishing station 22 for the supply of ink to the ink tanks 20. Further, a main tank 24 is disposed at a lower position of the ink jet printer 10.

Figure 1:
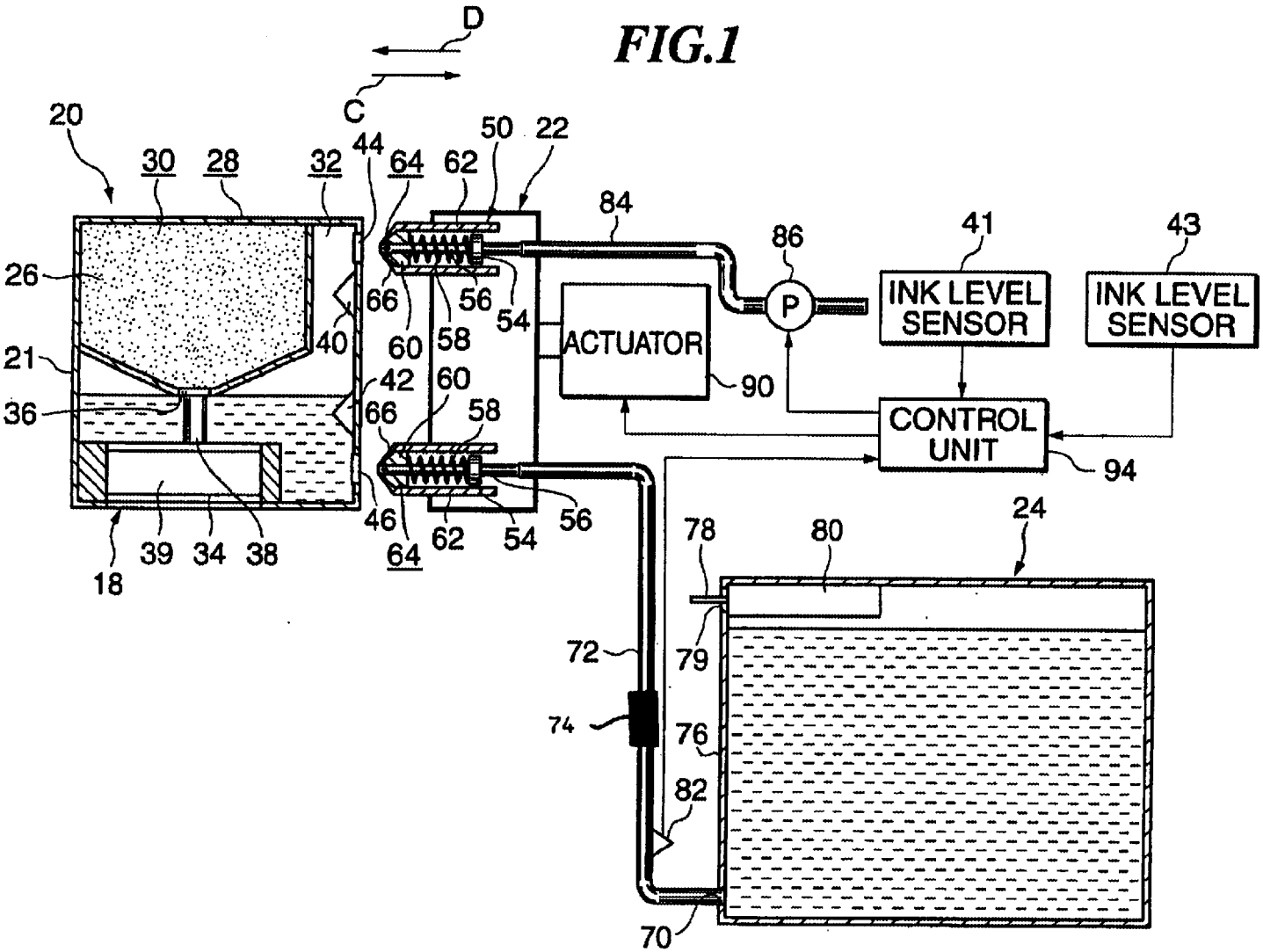
FIG. 1 is a schematic diagram showing an ink supply system in an ink jet printer according to the first embodiment of the present invention.
Figure 3:
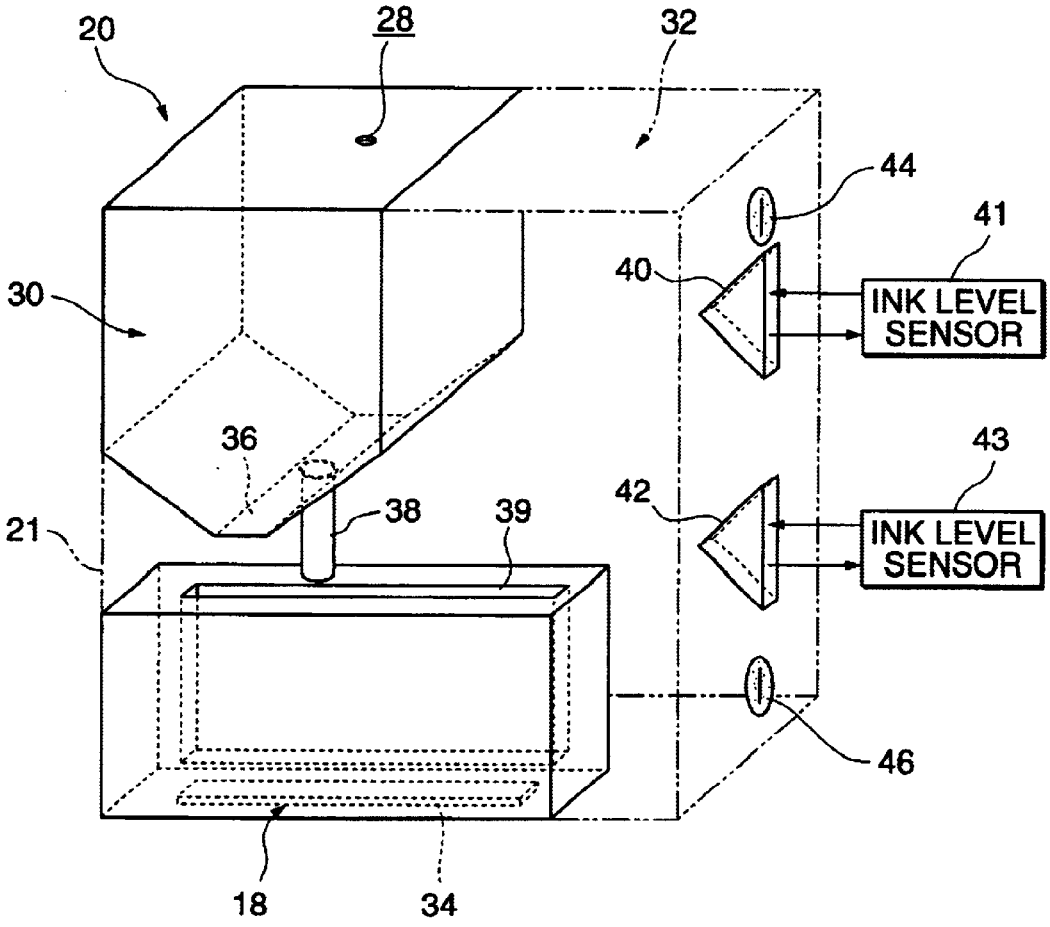
FIG. 3 is a schematic perspective view of an ink tank according to the first embodiment of the present invention.

As shown in FIGS. 1 and 3, the ink tanks 20 are each made up of a housing 21, a first ink chamber 30 in which is disposed a capillary member 26 for holding ink and which has an atmosphere communication port 28, a second ink chamber 32 which holds ink in a free state, and a head ink chamber 34 which is provided in the interior thereof with a head tip having an ink jet orifice.

The housing 21 is formed of polypropylene capable of fully suppressing moisture permeability and gas permeability, provided any other resin is employable insofar as it possesses ink resistance and can fully suppress moisture permeability and gas permeability. As the capillary member 26 disposed within the first ink chamber 30 there is used a polyester felt. The polyester felt is suitable because the capillarity can be adjusted with a change in density and also because of a high ink resistance. Of course, even porous polymer foams (e.g. polyurethane and melamine foams) and even polypropylene and acrylic felts other than polyester fibers are employable if only they can exhibit a moderate capillarity for the ink and possess ink resistance.

Each ink tank 20 is formed as a cartridge integrally with the print head 18. When the service life of the print head 18 expires, the whole of the cartridge is replaced. In a new cartridge, all of the first ink chamber 30, the second ink chamber 32, and the head ink chamber 34 are filled with ink.

At the bottom of the first ink chamber 30 is disposed a meniscus forming member 36 formed of a porous material having fine pores, through which pores the first and second ink chambers 30, 32 are communicated with each other. An ink conducting member 38 is attached to the bottom of the meniscus forming member 36 to ensure the supply of ink from the second ink chamber 32 to the meniscus forming member 36.

According to this construction, when ink is consumed by printing, air flows into the first ink chamber 30 through the atmosphere communication port 28 of the first ink chamber 30 and the ink contained in the capillary member 26 flows into the second ink chamber 32. Further, when the ink contained in the capillary member 26 is used up, air reaches the pores of the meniscus forming member 36. In each pore is formed an ink meniscus film, and due to a difference in pressure between the first and second ink chambers 30, 32 the film expands in a convex shape toward the interior of the second ink chamber 32 and is eventually ruptured, whereby air is fed into the second ink chamber 32 to keep a negative pressure state constant. On the other hand, since the pores with the meniscus film thus ruptured are supplied with ink from the ink conducting member 38, the ink meniscus film is reproduced soon and air is introduced into the second ink chamber 32 continuously to prevent impairment of the negative pressure state.

The head ink chamber 34 communicates with the second ink chamber 32 through a filter 39. The filter 39 is installed in the vertical direction on one side of the head ink chamber 34. For the ink consumed by ink ejection from the head ink chamber 34, the ink present in the second ink chamber 32 is supplied into the head ink chamber 34 through the filter 39. In this embodiment the head ink chamber 34 has a capacity of about 2 ml for the storage of bubbles which are formed with heat of the print head 18. In this embodiment, moreover, the print head portion is formed by micromachining a silicon wafer, and its nozzle portion has a resolution of about 600 dpi.

On a side face of the second ink chamber 32 are disposed two, upper and lower prisms 40, 42 for optical ink level sensors 41 and 43, respectively. In the ink level sensors 41 and 43, which are mounted in the ink jet printer 10, light is emitted from light emitting diodes to the prisms 40 and 42 in each of the color ink tanks 20 which move with the carriage 16, and reflected light is introduced into a phototransistor to detect the level of ink. More specifically, when ink is present on reflective surfaces of the prisms 40 and 42, incident light passes through the ink tank and is not reflected, while when ink is not present the reflective surfaces of the prisms 40 and 42, the reflective surfaces are designed to totally reflect the incident light, and upon incidence of reflected light on the phototransistor it is detected that the ink level has become lower than the prisms 40 and 42. The prism 40 is for detecting an upper limit of the ink level at the time of replenishing ink which will be described later, while the prism 42 is for detecting that the residual amount of ink has decreased to the ink level requiring the replenishment of ink.

In a side face of the second ink chamber 32 are provided slit valves 44 and 46 into which ports 50 and 52 to be described later are inserted respectively. The slit valves 44 and 46 have a slit structure using an elastic material such as rubber, and only when pipes 56 of the ink replenishing station 22 to be described later are inserted into the slit valves 44 and 46, the slit valves open while sealing in close contact with outer peripheral surfaces of the pipes 56. Except when the pipes 56 are thus inserted, the slit valves 44 and 46 are closed to keep the interior of the second ink chamber 32 in a hermetically sealed state and the negative pressure can be controlled in a certain range. The slit valve 44 is located above the prism 40 and the slit valve 46 below the prism 42. This is for the following reason. Since air is creation to be discharged from the port 50 which is inserted into the slit valve 44, the slit valve 44 is disposed above the upper limit of ink level, while the slit valve 46 is disposed below the lower limit of ink level for the supply of ink into the ink present in the second ink chamber 32 through the port 52 which is inserted into the slit valve 46.

The following description is now provided about an ink supply (replenishing) system for the supply of ink to the ink tank 20 thus constructed.

The ink replenishing station 22 has two ports 50 and 52 for connection to the ink tank 20. As shown in FIG. 1, the port 50 is made up of a base 54, a pipe 56 extending through the base 54, a spring 58 wound round the pipe 56, a support member 60 which is movable along the pipe 56, and a protective cover 62 supported by the support member 60.

The pipe 56 has a passage formed in the interior thereof and it is in communication with the exterior through a lateral hole 64 formed in the vicinity of a front end thereof. The front end of the pipe 56 is shielded from the exterior by a conical sealing portion 66 formed at a front end of the protective cover 62, thereby preventing the evaporation and denaturation of ink in the lateral hole 64.

The spring 58 is disposed between the base 54 and the support member 60, so when a force acting in arrow C direction is exerted on the protective cover 62, the spring 58 is compressed and both the support member 60 and protective cover 62 move in arrow C direction, so that the pipe 56 is exposed to the exterior.

The pipe 56 in the port 50 is connected to an exhaust pipe 84 which is open to the atmosphere, with an exhaust pump 86 being disposed halfway.

In the port 52, which has the same construction as the port 50, the pipe 56 is connected through a supply pipe 72 to a supply port 70 formed in the bottom portion of the main tank 24.

Figure 4:
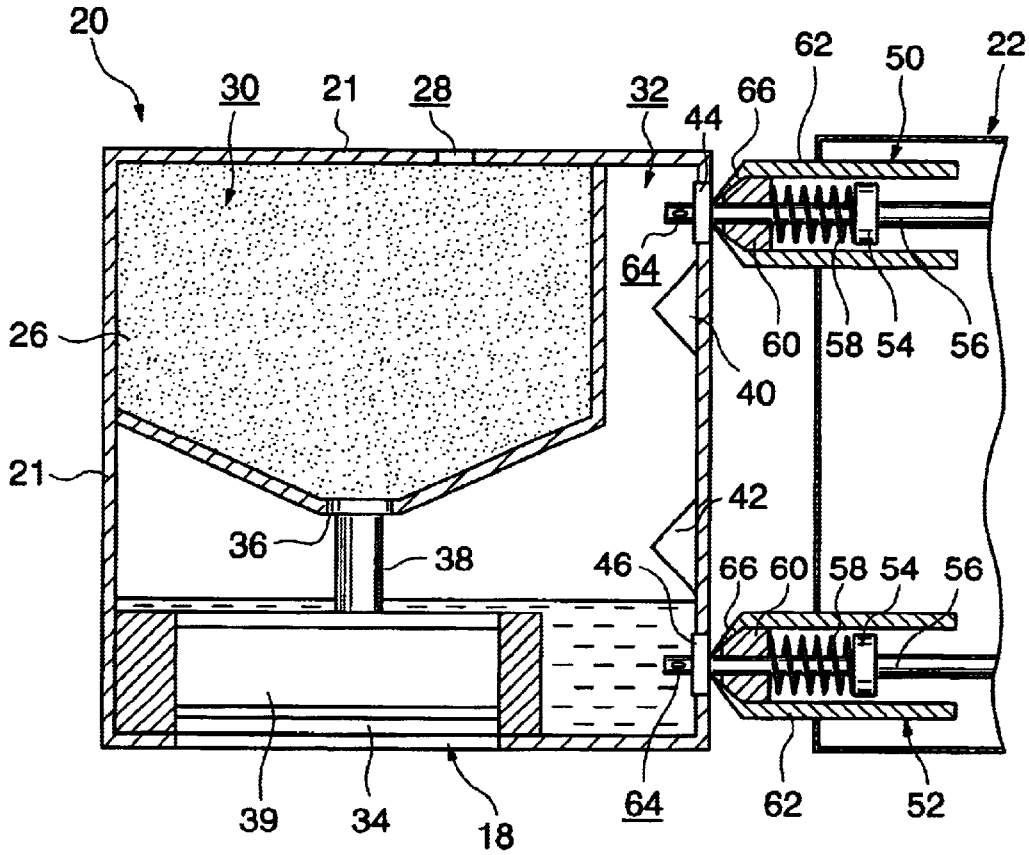
FIG. 4 is a sectional view showing in what state ports are connected to the ink tank according to the first embodiment of the present invention.

The ink replenishing station 22 having the ports 50 and 52 is constructed so as to be movable (in the directions of arrows D and C) into contact with and away from a side face of the ink tank 20 by means of an actuator 90. As the replenishing station 22 is moved toward the side face of the ink tank 20, the protective covers 62 in both the ports 50 and 52 come into abutment against the side face of the ink tank and the springs 58 are compressed. As a result, the front ends (lateral holes 64) of the pipes 56 exposed from the protective covers 62 get into the second ink chamber 32 through the slit valves 44 and 46 (see FIG. 4).

The main tank 24 adopts a method wherein ink is stored in a free state within a housing 76 formed of a polypropylene resin. According to the structure of the main tank, its atmosphere release port is brought into communication with the atmosphere when it is loaded into the ink jet printer 10. To be more specific, the main tank 24 is provided with a pipe 78 formed on the ink jet printer 10 side and communicating with the atmosphere. When the main tank 24 is loaded into the ink jet printer 10, the pipe 78 is inserted into a slit valve 79 formed of an elastic material such as rubber, the slit valve 79 sealing the main tank 24 hermetically from the exterior, whereby the main tank 24 is released to the atmosphere. Thus, during shipping, the slit valve 79 is closed to prevent the leakage of ink in transit. Inside the slit valve 79 is formed a passage 80 of a labyrinth structure to prevent the leakage and evaporation of ink.

A residual ink quantity sensor 82 for detecting the residual quantity of ink in the main tank 24 is disposed in the supply pipe 72. When the residual ink quantity sensor 82 detects the absence of ink in the supply pipe 72, it is judged that the residual quantity of ink in the main tank 24 is small, and a replacement message for the main tank 24 can be displayed.

There may be adopted a construction wherein an ink appropriateness detecting part 74 for detecting transmitted light through the ink in the supply pipe 72 is provided and there is made identification of the ink on the basis of the attenuation rate of the transmitted light, then upon detection of inappropriate ink the replacement of the main tank 24 and the ink tank 20 is instructed.

In the ink jet printer 10 there are provided an actuator 90 for the supply of ink from the main tank 24 to the ink tank 20 in accordance with output signals provided from the ink level sensors 41, 43 and the residual ink quantity sensor 82, and a control unit 94 which outputs a drive signal to the pump 86.

The operation of the ink jet printer 10 thus constructed will be described below.

First, in normal printing, ink is fed from the capillary member 26 in the first ink chamber 30 to the second ink chamber 32 as the ink is consumed. When the ink contained in the capillary member 26 is used up, the air present in the first ink chamber 30 causes the ink meniscus film formed in the pores of the meniscus forming member 36 to be ruptured and enters the second ink chamber 32 to maintain the negative pressure condition in the second ink chamber 32 constant, whereby ink is ejected from the head ink chamber 34 in a stable manner. Further, when the ink level in the second ink chamber 32 becomes lower than the prism 42 with consumption of ink, incident light emitted from the light emitting diode in the ink level sensor 43 is totally reflected by the reflective surface of the prism 42 and the reflected light is incident on the phototransistor. As a result, the lowering of the ink level is detected and a detected signal is outputted from the ink level sensor 43 to the control unit 94. The control unit 94 judges that the replenishment of ink is needed, and makes control to terminate the printing operation of the print head 18 and return the carriage 16 to its home position. Further, a drive signal is outputted from the control unit 94 to the actuator 90, the ink replenishing station 22 approaches a side face of the ink tank 20 which is located at the home position, and the protective cover 62 comes into abutment against the side face. With a further movement of the station 22 in arrow D direction, the springs 58 are compressed, the pipes 56 are exposed from the protective cover 62, and the front ends (lateral holes 64) are inserted into the second ink chamber 32 through the slit valves 44 and 46 (see FIG. 4). As a result, the pipe 56 in the port 50 is inserted into the air present in the second ink chamber 32, while the pipe 56 in the port 52 is inserted into the ink present in the second ink chamber 32. Now, the control unit 94 makes control to terminate the operation of the actuator 90 and actuate the pump 86, whereby the air present in the second ink chamber 32 is discharged to the exterior through the exhaust pipe 84. Consequently, the negative pressure in the second ink chamber 32 increases and ink is supplied from the main tank 24 to the second tank chamber through the supply pipe 72, the associated pipe 56 and later hole 64.

When the ink level in the second ink chamber 32 reaches the position of the prism 40 with the supply of ink, the ink level sensor 41 detects this state and outputs a detected signal to the control unit 94. Upon receipt of this detected signal the control unit 94 outputs an OFF signal to the pump 86 to stop the operation of the pump. Further, the control unit 94 causes the actuator 90 to operate, thereby causing the ink replenishing station 22 to be spaced apart from the ink tank 20. As a result, the pipes 56 in the ports 50 and 52 are pulled out from the slit valves 44 and 46, respectively, and with return of the springs 58 the protective covers 62 close the lateral holes 64. Thus, it is possible to prevent the evaporation of ink from the pipes 56 (lateral holes 64) or prevent solidifying of adhered ink. Immediately after the pipes have been pulled out, the slit valves 44 and 46 formed in a side face of the ink tank 20 also seal the respective openings by virtue of their elasticity, thereby preventing the leakage of ink.

Thus, in the ink jet printer 10 of this embodiment, for the replenishment of ink from the main tank 24 to the ink tank 20, the ports 50 and 52 are connected to the second ink chamber 32 in the ink tank 20 and the air present in the second ink chamber 32 is discharged from the port 50 with use of the pump 86 to increase the negative pressure of the second ink chamber 32, thereby sucking ink from the main tank 24 into the second ink chamber 32. Thus, since the ink is supplied by a negative pressure, there is no fear that the ink may leak from the slit valve 46 into which the pipe 56 in the port 52 is inserted.

When the pipes 56 in the ports 50 and 52 are inserted into the slit valves 44 and 46, it is possible to not only close the atmosphere communication port 28 in the first ink chamber 30 but also cap the nozzle orifice in the print head 18. According to this construction, it is possible to prevent the entry of air from the atmosphere communication port 28 or from the nozzle orifice of the ink head 18 with an increase in negative pressure of the second ink chamber 32 caused by operation of the pump 86. But even in the event of entry of air, the replenishment of ink can be done to a satisfactory extent by keeping the flow path resistance in the supply pipe 72 and the pipes 56 fully low. The entered air is discharged to the exterior by the pump 86.

The pressure of the ink tank 20 is controlled not by a head pressure with respect to the main tank 24, but independently of the main tank 24. That is, the place where the main tank 24 is to be installed is not restricted and thus the degree of freedom in the arrangement of components is enhanced.

Although according to the construction of this embodiment the replenishment of ink is performed at the home position, the ink replenishing position is not limited to the home position, but may be another position.

Figure 5:
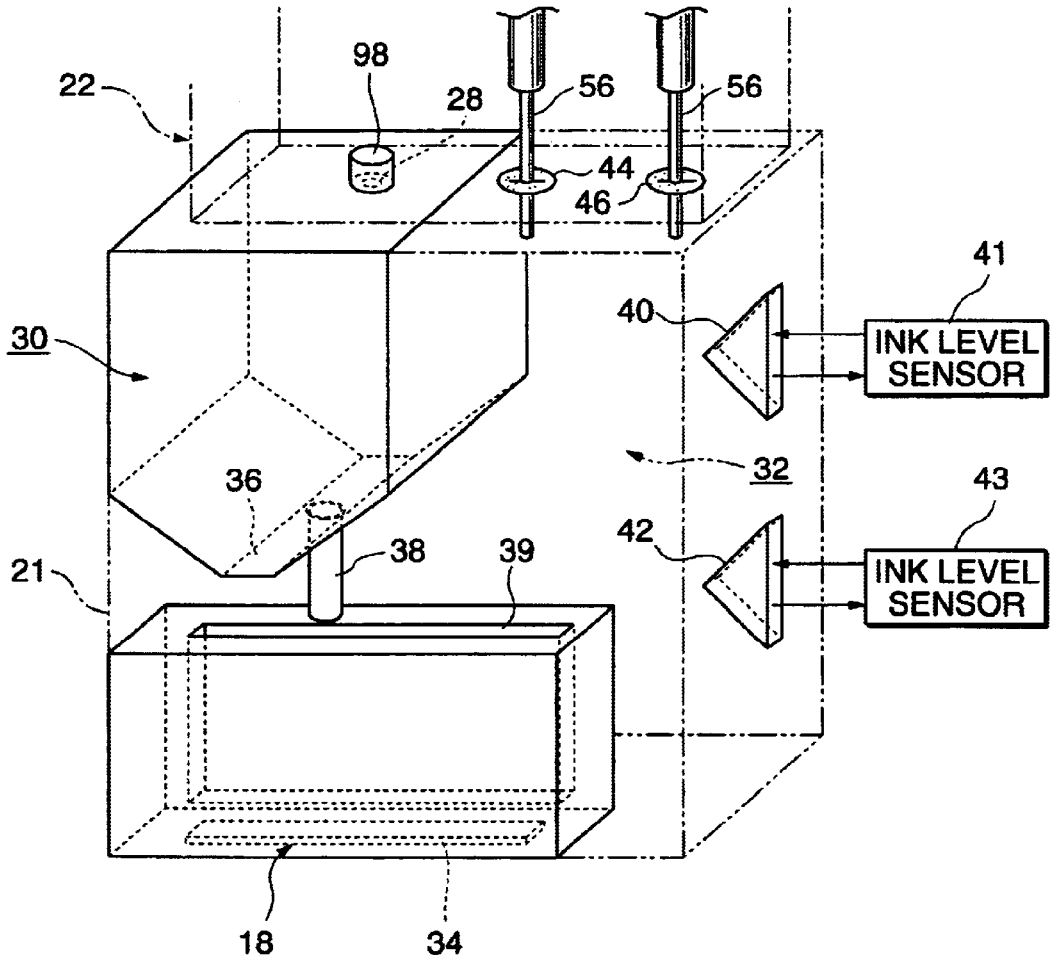
FIG. 5 is a schematic perspective view of an ink tank used in the second embodiment of the present invention.

An ink jet printer according to the second embodiment of the present invention will be described below with reference to FIG. 5. In the second embodiment the same components as in the above first embodiment are identified by the same reference numerals as in the first embodiment and explanations thereof will be omitted.

This second embodiment is different from the first embodiment in that slit valves 44 and 46 are formed in an upper surface of an ink tank 20 and that from above the ink tank 20 the ink replenishing station 22 approaches and leaves the ink tank.

A closure member 98 for closing an atmosphere communication port 28 formed in a first ink chamber 30 is provided in the ink replenishing station 22.

According to this construction, not only the same function and effect as in the first embodiment are attained, but also it is possible to prevent air from being fed from the atmosphere communication port 28 into a second ink chamber 32 through the first ink chamber 30 with an increase in negative pressure of the second ink chamber 32 at the time of replenishing ink. Consequently, the ink supply efficiency from the main tank 24 can be improved.

Moreover, since the closure member 98 is provided in the ink replenishing station 22, not only the pipes 56 in the ports 50 and 52 can be inserted into the slit valves 44 and 46, respectively, but also the closure member 98 can close the atmosphere communication port 28, by a single operation of approximating the ink replenishing station 22 to the upper surface of the ink tank 20.

Further, since the pipes 56 for the supply of ink are not soaked in ink during the supply of ink, it is possible to keep the amount of ink adhered to the pipes 56 to a minimum and hence possible to prevent clogging of the pipes 56 caused by solidifying of adhered ink.

In the ink jet printer according to the present invention, as set forth above, at the time of supplying ink from the main tank installed outside the carriage into the ink tank installed on the carriage, it is possible to surely prevent the leakage of ink and effect the replenishment of ink in a stable manner.

What is claimed is:

1. An ink jet printer comprising:

an ink tank which is held on a movable carriage with a print head mounted thereon and in which ink is held so as to have a free surface, the ink tank having plural to-be-connected portions for the replenishment of ink, one of the to-be-connected portions is located above the free surface of the ink and the other of the to-be-connected portions is located below the free surface of the ink;

a main tank disposed outside the movable carriage and with the ink stored therein;

a first connecting portion communicating with the main tank;

a second connecting portion through which air is discharged to the exterior by an air suction part, wherein the air suction part is a pump; and a connecting part which, at the time of ink supply, connects the first and second connecting portions to the respective to-be-connected portions of the ink tank.

2. An ink jet printer according to claim 1, wherein the to-be-connected portions of the ink tank and the first and second connecting portions are connected together when the movable carriage is at home position thereof.

3. An ink jet printer according to claim 1, wherein the main tank is provided with an atmosphere release port which is opened when the main tank is loaded into the ink jet printer.

4. An ink jet printer comprising:

an ink tank which is held on a movable carriage with a print head mounted thereon and in which ink is held so as to have a free surface, the ink tank including:

a plural to-be-connected portions for the replenishment of ink, a first ink chamber having an atmosphere communication port and with an ink holding capillary member accommodated therein, a second ink chamber which holds the ink so as to have a free surface, the second ink chamber having an ink supply port for the supply of ink to the print head and also having the to-be-connected portions, and a meniscus forming member provided in a communicating portion between the first and second ink chambers;

a main tank disposed outside the movable carriage and with the ink stored therein;

a first connecting portion communicating with the main tank;

a second connecting portion through which air is discharged to the exterior by an air suction part;

a connecting part which, at the time of ink supply, connects the first and second connecting portions to the respective to-be-connected portions of the ink tank;

a residual ink quantity detecting part which detects a residual ink quantity in the second ink chamber; and a control part which, when the residual ink quantity is found to be not more than a predetermined quantity by the residual ink quantity detecting part, makes control to drive the connecting part so as to connect the first and second connecting portions to the respective to-be-connected portions in the second ink chamber and also makes control to actuate the air suction part so as to replenish ink from the main tank to the ink tank.

5. An ink jet printer according to claim 4, further comprising a closing part which closes the atmosphere communication port of the first ink chamber at the time of replenishing ink from the main tank to the ink tank.

6. An ink jet printer according to claim 4, wherein the residual ink quantity detecting part is an optical sensor which detects an ink level on the basis of a change in light transmittance caused by whether ink is present or not.

7. An ink jet printer according to claim 4, wherein the to-be-connected portions are provided in an upper portion of the ink tank.

8. An ink containment system for an ink jet printer comprising:

an ink tank to be attached to a movable carriage, wherein the ink tank is configured to contain ink so as to have a free surface, the ink tank including:

a plurality of to-be-connected portions for the replenishment of ink, wherein at least one of the to-be-connected portions is attached to the ink tank below the free surface of the ink, and a print head adjacent the ink tank;

a main tank disposed outside the movable carriage for storing ink;

a first connecting portion communicating with the main tank;

an air suction pump;

a second connecting portion through which air is discharged to the exterior by the air suction pump; and a connecting part which, at the time of ink supply, connects the first and second connecting portions to respective to-be-connected portions of the ink tank.

9. The ink containment system of claim 8, wherein the ink tank includes a first and second ink chamber, the second ink chamber being configured to contain the ink so as to have the free surface, and the second ink chamber including the to-be-connected portions for the replenishment of ink.

10. The ink containment system of claim 9, further including an atmosphere communication port and an ink holding capillary member located in the first ink chamber.

11. The ink containment system of claim 10, further including a closing part, wherein the closing part closes the atmosphere communication port of the first ink chamber at the time of replenishing ink from the main tank to the ink tank.

12. The ink containment system of claim 9, further including a meniscus forming member provided in a communicating portion between the first and second ink chambers.

13. The ink containment system of claim 8, further including a residual ink quantity detecting part which detects a residual ink quantity in the ink tank.

14. The ink containment system of claim 8, further including a control part, wherein the control part drives the connecting part so as to connect the first and second connecting portions to the respective to-be-connected portions in the ink tank, and actuates the air suction part so as to replenish ink from the main tank to the ink tank when residual ink quantity as determined by a residual ink quantity detecting part is less than a predetermined quantity.

15. The ink containment system of claim 8, further comprising a defective ink detecting part which detects defective ink on the basis of the rate of attenuation of light passing through the ink in the communication path between the main tank and the first connecting portion.

16. An ink control system comprising:

an ink tank being attached to a movable carriage, the ink tank including a print head;

a first connecting portion connected with an ink supply;

a second connecting portion;

an air suction part in fluid communication with the first and second connecting portions for discharging air to the atmosphere, and drawing ink from the ink supply;

an ink quantity detecting part for detecting an ink quantity in the ink tank;

to-be-connected portions attached to the ink tank;

a connecting part associated with the first and second connecting portions; and a control part, wherein the control part drives the connecting part to a first position connecting the first and second connecting portions to the respective to-be-connected portions on the ink tank and actuates the air suction part so as to draw ink from the ink supply to the ink tank when the ink quantity detecting part detects less than a predetermined quantity.

17. An ink control system comprising:

an ink tank being attached to a movable carriage, the ink tank including a print head;

a first connecting portion connected with an ink supply;

a second connecting portion;

an air suction part in fluid communication with the first and second connecting portions for discharging air to the atmosphere, and drawing ink from the ink supply;

an ink quantity detecting part for detecting an ink quantity in the ink tank;

to-be-connected portions attached to the ink tank;

a connecting part associated with the first and second connecting portions; and a control part, wherein the control part drives the connecting part to a second position disconnecting the first and second connecting portions from the respective to-be-connected portions on the ink tank and deactivates the air suction part so as to cease the flow of replenished ink from the ink supply to the ink tank when residual ink quantity as detected by the ink quantity detecting part is greater than a predetermined quantity.

* * * * *